US008569216B2

(12) United States Patent
Blain et al.

(10) Patent No.: US 8,569,216 B2
(45) Date of Patent: Oct. 29, 2013

(54) LUBRICANT FORMULATION WITH HIGH OXIDATION PERFORMANCE

(75) Inventors: David A. Blain, Cherry Hill, NJ (US); Liehpao Oscar Farng, Lawrenceville, NJ (US); Eugenio Sanchez, Pitman, NJ (US); Michael R. Douglass, Cherry Hill, NJ (US); Angela S. Galiano-Roth, Mullica Hill, NJ (US); James T. Carey, Medford, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 230 days.

(21) Appl. No.: 13/161,906

(22) Filed: Jun. 16, 2011

(65) Prior Publication Data

US 2012/0322705 A1 Dec. 20, 2012

(51) Int. Cl.
*C10M 137/10* (2006.01)
*C10M 133/12* (2006.01)

(52) U.S. Cl.
USPC ..... 508/430; 508/429; 508/563

(58) Field of Classification Search
USPC ..... 508/429, 430, 563
See application file for complete search history.

(56) References Cited

U.S. PATENT DOCUMENTS

| | | | | |
|---|---|---|---|---|
| 3,149,178 | A | 9/1964 | Hamilton et al. | |
| 3,382,291 | A | 5/1968 | Brennan | |
| 3,742,082 | A | 6/1973 | Brennan | |
| 3,769,363 | A | 10/1973 | Brennan | |
| 3,780,128 | A | 12/1973 | Shubkin | |
| 3,876,720 | A | 4/1975 | Heilman et al. | |
| 4,172,855 | A | 10/1979 | Shubkin et al. | |
| 4,189,453 | A | 2/1980 | Zinke et al. | |
| 4,197,209 | A | 4/1980 | Zinke et al. | |
| 4,239,930 | A | 12/1980 | Allphin et al. | |
| 4,251,469 | A * | 2/1981 | Zinke et al. | 558/180 |
| 4,367,352 | A | 1/1983 | Watts, Jr. et al. | |
| 4,413,156 | A | 11/1983 | Watts, Jr. et al. | |
| 4,434,408 | A | 2/1984 | Baba et al. | |
| 4,704,491 | A | 11/1987 | Tsutsui et al. | |
| 4,827,064 | A | 5/1989 | Wu | |
| 4,910,355 | A | 3/1990 | Shubkin et al. | |
| 4,914,254 | A | 4/1990 | Pelrine | |
| 4,917,809 | A | 4/1990 | Zinke et al. | |
| 4,926,004 | A | 5/1990 | Pelrine et al. | |
| 4,956,122 | A | 9/1990 | Watts et al. | |
| 4,967,032 | A | 10/1990 | Ho et al. | |
| 5,068,487 | A | 11/1991 | Theriot | |
| 5,087,788 | A | 2/1992 | Wu | |
| 5,688,887 | A | 11/1997 | Bagheri et al. | |
| 6,043,401 | A | 3/2000 | Bagheri et al. | |
| 6,133,209 | A | 10/2000 | Rath et al. | |
| 6,180,575 | B1 | 1/2001 | Nipe | |
| 6,414,091 | B2 | 7/2002 | Moritomi et al. | |
| 6,534,452 | B1 | 3/2003 | Butler | |
| 6,689,726 | B1 | 2/2004 | Holt | |
| 6,706,828 | B2 | 3/2004 | DiMaio | |
| 6,713,438 | B1 | 3/2004 | Baillargeon et al. | |
| 6,825,154 | B1 | 11/2004 | Holt | |
| 2003/0055184 | A1 | 3/2003 | Song et al. | |
| 2004/0147693 | A1 | 7/2004 | DiMaio | |
| 2008/0207475 | A1 * | 8/2008 | Haigh et al. | 508/463 |
| 2009/0036725 | A1 | 2/2009 | Wu et al. | |

FOREIGN PATENT DOCUMENTS

| | | |
|---|---|---|
| EP | 0613873 A1 | 9/1994 |
| WO | 9623751 | 8/1996 |
| WO | 03020856 A1 | 3/2003 |

OTHER PUBLICATIONS

N.M.Simkovsky and A. Ecker, "Effect of Antioxidants on the Oxidative Stability of Rapeseed Oil Methyl Esters", Erdol Erdgas Kohle, 1999, 115 (6), 317-318.

* cited by examiner

*Primary Examiner* — Prem C Singh
*Assistant Examiner* — Francis C Campanell
(74) *Attorney, Agent, or Firm* — Robert A. Migliorini

(57) ABSTRACT

A Group IV/Group V lubricating composition providing improved antioxidation performance comprises from 5 wt. % to 40 wt. % of a Group V base oil component, such as alkylated naphthalene, at least 30 wt. % of a Group IV base oil component, such as one or more polyalphaolefin base stocks, and from 0.25 wt. % to 1.5 wt. % of a trithiophosphate-containing compound. The trithiophosphate-containing compound is preferably $C_{30}H_{57}O_7PS_3$. The lubricating composition includes not greater than 5 wt. % of a Group I, Group II, or Group III base oil component, and, preferably not greater than 10 ppm heavy metal component. The lubricating composition preferably has a kinematic viscosity of from 20 cSt to 1,000 cSt at 40° C. and a viscosity index (VI) of from 130 to 200.

12 Claims, No Drawings

LUBRICANT FORMULATION WITH HIGH OXIDATION PERFORMANCE

FIELD OF THE INVENTION

This invention is directed to a lubricating composition comprising in admixture a blend of a Group V base oil component, a Group IV base oil component and a trithiophosphate-containing compound. This invention is also directed to a method of improving antioxidation performance of a lubricating composition.

BACKGROUND OF THE INVENTION

Manufacturers and users of lubricating compositions desire to improve performance by extending oil drain life of the lubricating composition. Extended drain life is a critical marketing feature of lubricating compositions, especially Group IV/Group V lubricating compositions.

Degree of oxidation of the lubricating composition, also referred to as oxidation stability, affects the oil drain life of the lubricating composition. Oxidative degradation of lubricating composition can lead to damage of metal machinery in which the lubricating composition is used. Such degradation may result in deposits on metal surfaces, the presence of sludge, or a viscosity increase in the lubricating composition.

The kinematic viscosity of a lubricating composition is directly related to the antioxidation performance and degree of oxidation of the lubricating composition. A lubricating composition being used in machinery has experienced oxidative degradation when the kinematic viscosity of lubricating composition reaches a certain level, and the lubricating composition needs to be replaced at that level. Improving the oxidation stability and antioxidation performance of the lubricating composition improves the oil drain life by increasing the amount of time the lubricating composition can be used before being replaced. Various approaches are used to improve the antioxidation performance and extend the oil drain life of Group IV/Group V lubricating compositions. The approaches typically involve increasing the antioxidant additive concentrations of the lubricating composition.

U.S. Pat. No. 6,180,575 to Nipe and assigned to Mobil Oil Corporation discloses lubricating compositions comprising antioxidant additives and API Group II-V base stocks, such as a polyalphaolefin base stocks and alkylated naphthalene base stocks. The antioxidant additives include phenolic antioxidants, such as ashless phenolic compounds, and neutral, or basic metal salts of phenolic compounds. Typical of the dialkyl dithiophosphate salts which may be used are the zinc dialkyl dithiophosphates, especially the zinc dioctyl and zinc dibenzyl dithiophosphates (ZDDP). These salts are often used as anti-wear agents but they have also been shown to possess antioxidant functionality. The antioxidant additives of the '575 patent also include amine type antioxidants, alkyl aromatic sulfides, phosphorus compounds such as phosphites and phosphonic acid esters, and sulfur-phosphorus compounds such as dithiophosphates and other types such as dialkyl dithiocarbamates, e.g. methylene bis(di-n-butyl) dithiocarbamate. The antioxidant additives may be used individually or in combination with one another.

Lubricating compositions having extended drain life, as well as greater resistance to oxidation stability, are highly desired. In particular, lubricating compositions that have extended drain life and higher oxidation stability and use relatively low levels of heavy metals are highly desirable.

SUMMARY OF THE INVENTION

This invention provides a lubricating composition comprising in admixture a blend of a Group V base oil component, a Group IV base oil component, and a trithiophosphate-containing compound that has improved antioxidation performance and thus extended oil drain life, compared to other lubricating compositions. The lubricating composition is of particular benefit in that it contains little to no heavy metals.

According to one aspect of the invention, there is provided a lubricating composition produced from a blend of components. According to another aspect of the invention there is provided a method of producing a lubricating composition, which comprises blending the components together. According to a further aspect of the invention, there is provided a method for improving the antioxidation performance of a lubricating composition, which comprises adding to the lubricating composition a trithiophosphate-containing compound.

The blend of components comprises from 5 wt. % to 40 wt. % of a Group V base oil component, at least 30 wt. % of a Group IV base oil component, from 0.25 wt. % to 1.5 wt. % of a trithiophosphate-containing compound, and not greater than 5 wt. % of a Group I, Group II, or Group III base oil, based on the total weight of the blend components that are used to produce the lubricating composition.

In one embodiment, the trithiophosphate-containing compound has the following structure:

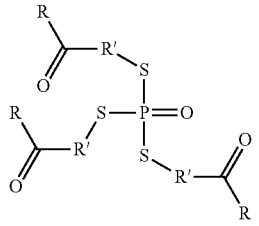

wherein each substituent R group is independently selected from a linear or branched alkoxy or amine functionality, and each substituent R' group is independently selected from —$CH_2$—, —$CH_2CH_2$—, and —$CH(CH_3)$—.

In one preferred embodiment, the trithiophosphate-containing compound has the following structure:

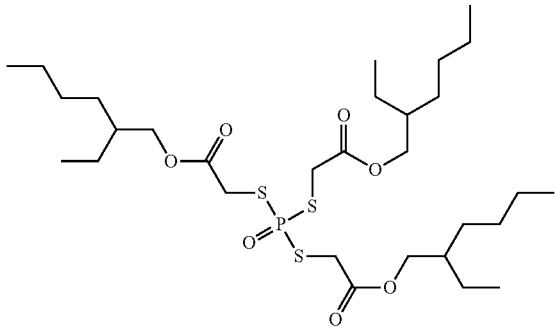

In one embodiment, the trithiophosphate-containing compound is S,S,S-Tris-carbo-2-isooctyloxy-methyl trithiophosphate.

The trithiophosphate-containing compound typically has a $M_w$ of 600 g/mol to 700 g/mol.

The lubricating composition preferably includes not greater than 1 wt. % of the trithiophosphate-containing compound, based on the total weight of the blend components that are used to produce the lubricating composition.

In one embodiment, the lubricating composition includes from 0.25 wt. % to 1.5 wt. % of an alkylated amine, based on the total weight of the blend components that are used to produce the lubricating composition.

In one embodiment, the alkylated amine is an aromatic amine, such as an alkylated diphenyl amine.

In one embodiment, the lubricating composition includes not greater than 1 wt. % of the trithiophosphate-containing compound and not greater than 1 wt. % of the alkylated amine, based on the total weight of the blend components that are used to produce the lubricating composition.

Preferably, the lubricating composition comprises not greater than 10 parts per million (ppm) of a heavy metal component, based on the total weight of the components that are used to produce the lubricating composition.

In one embodiment, the lubricating composition comprises a total of at least 80 wt. % of the combined Group V base oil component and the Group IV base oil component, preferably at least 90 wt. %, based on the total weight of the blend components that are used to produce the lubricating composition.

In one embodiment, the lubricating composition comprises from 10 wt. % to 30 wt. % of the Group V base oil component and from 70 wt. % to 90 wt. % of the Group IV base oil component, based on the total weight of the blend components that are used to produce the lubricating composition.

In one embodiment, at least one of the Group V base stocks in the Group V base oil component is selected from the group consisting of an alkylated aromatic and an ester.

In another embodiment, the Group IV base oil component has a kinematic viscosity of from 2 cSt to 2000 cSt at 40° C.

In one embodiment, the blended lubricating composition has a kinematic viscosity of from 20 cSt to 1000 cSt at 40° C., and preferably a viscosity index (VI) of from 130 to 200.

In one embodiment, the lubricating composition has an ISO VG grade of from 22 to 1000.

DETAILED DESCRIPTION OF THE INVENTION

I. Introduction

A Group IV/Group V lubricating composition is produced from a blend of components comprising a Group V base oil component, a Group IV base oil component, and a trithiophosphate-containing compound. The lubricating composition has improved oxidation stability and thus extended oil drain life, compared to other lubricating compositions.

The blend of components includes from 5 wt. % to 40 wt. % of a Group V base oil component, at least 30 wt. % of a Group IV base oil component, and from 0.25 wt. % to 1.5 wt. % of a trithiophosphate-containing compound, based on the total weight of the blend components that are used to produce the lubricating composition. The Group V base oil component comprises one or more Group V base stocks, such as alkylated naphthalene. The Group IV base oil component comprises one or more Group IV base stocks, such as polyalphaolefin base stocks. The blend of components also includes not greater than 5 wt. % of a Group I, Group II, or Group III base oil.

Unless specified otherwise, the weight percent (wt. %) of a component is defined as the percent portion of the subject component as a fraction of the whole blended lubricating composition, which is 100 wt. %. The wt. % of each component can be measured using a balance scale, according to methods known in the art, before blending the components together.

II. Group V Base Oil Component

The lubricating composition comprises a Group V base oil component. The Group V base oil component is considered to be a composition comprised of a Group V base stock or a blend of more than one Group V base stocks. Group V base stocks include all other base stocks not included in Group I, II, III, or IV, as set forth in APPENDIX E—API BASE OIL INTERCHANGEABILITY GUIDELINES FOR PASSENGER CAR MOTOR OILS AND DIESEL ENGINE OILS, July 2009 Version. Group I base stocks contain less than 90 percent saturates, tested according to ASTM D2007 and/or greater than 0.03 percent sulfur, tested according to ASTM D1552, D2622, D3120, D4294, or D4927; and a viscosity index of greater than or equal to 80 and less than 120, tested according to ASTM D2270. Group II base stocks contain greater than or equal to 90 percent saturates; less than or equal to 0.03 percent sulfur; and a viscosity index greater than or equal to 80 and less than 210. Group III base stocks contain greater than or equal to 90 percent saturates; less than or equal to 0.03 percent sulfur; and a viscosity index greater than or equal to 120. Group IV base stocks are polyalphaolefins (PAOs).

The terms "base oil" and "base stock" as referred to herein are to be considered consistent with the definitions as also stated in API APPENDIX E. According to Appendix E, the base oil is the base stock or blend of base stocks used in an API-licensed oil. Base stock is a lubricating composition component that is produced by a single manufacturer to the same specifications (independent of feed source or manufacturer's location); that meets the same manufacturer's specification; and that is identified by a unique formula, product identification number, or both.

The Group V base oil component comprises one or more Group V base stocks. In one embodiment, the Group V base oil component is comprised of one or more Group V base stocks selected from the group consisting of alkylated aromatics and esters. Examples of alkylated aromatics include, but are not limited to alkylated naphthalene and alkylated benzene, also referred to as alkylnapthalenes and alkylbenzenes. In one preferred embodiment, the Group V base oil component is alkylated naphthalene.

The alkylnaphthalenes can include a single alkyl chain (monalkylnaphthalene), two alkyl chains (dialkylnaphthalene), or multiple alkyl chains (polyalkylnaphthalene). The alkylbenzenes can include a single alkyl chain (monalkylbenzene), two alkyl chains (dialkylbenzne), or multiple alkyl chains (polyalkylbenzene). Each alkyl group present can be independently represented by a $C_1$-$C_{30}$ alkyl group, which can be linear or branched. In one embodiment, each alkyl group is represented by a $C_{10}$-$C_{14}$ alkyl group.

In one embodiment, the alkylated naphthalene has a kinematic viscosity of from 2 cSt to 30 cSt, or from 3 cSt to 25 cSt, or from 4 cSt to 20 cSt.

Examples of esters include, but are not limited to polyol esters (reaction products of at least one carboxylic acid, i.e., mono-basic or multi-basic carboxylic acid, and at least one polyol) and complex alcohol esters (reaction products of at least one polyol, multi-basic carboxylic acid and mono-alcohol). Specific examples of polyol esters include, but are not limited to, di-iso tridecyl adipate, diiosoctyl ester and trimethylolpropane esters of $C_8$-$C_{10}$ acids. A specific example of a carboxylic acid includes, but is not limited to, hexanedioic acid.

Additional examples of esters include esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with any one or more of a variety of alcohols (e.g., butyl alcohol, hexyl alcohol, dodecyl alcohol, 2-ethylhexyl alcohol, ethylene glycol, diethylene glycol monoether, propylene glycol). These esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate and dieicosyl sebacate. Other examples of esters include those made from $C_5$ to $C_{12}$ monocarboxylic acids and polyols and polyol esters, such as neopentyl glycol, pentaerythritol, dipentaerythritol, and tripentaerythritol.

The Group V base oil component of the lubricating composition has a blend concentration of from 5 wt. % to 40 wt. %, based on the total weight of the blend components that are used to produce the lubricating composition.

In one embodiment, the Group V base oil component has a blend concentration of at least 5 wt. %. In another embodiment, the Group V base oil component has a blend concentration of at least 10 wt. %, or at least 15 wt. %, or at least 20 wt. %, based on the total weight of the blend components that are used to produce the lubricating composition.

In one embodiment, the Group V base oil component of the lubricating composition has a blend concentration of not greater than 40 wt. %, based on the total weight of the blend components that are used to produce the lubricating composition. In another embodiment, the Group V base oil component of the lubricating composition has a blend concentration of not greater than 35 wt. %, or not greater than 30 wt. %, or not greater than 25 wt. % based on the total weight of the blend components that are used to produce the lubricating composition.

Examples of the ranges of the amount of Group V base oil component that can be blended with the other components of the lubricating composition include from 5 wt. % to 40 wt. %, or from 10 wt. % to 35 wt. %, or from 15 wt. % to 30 wt. %, based on the total weight of the blend components that are used to produce the lubricating composition.

In one embodiment, the Group V base oil component of the lubricating composition of this invention has a kinematic viscosity of less than 50 cSt at 100° C., or less than 35 cSt, or less than 20 cSt at 100° C., or less than 10 cSt at 100° C.

In one embodiment, the Group V base oil component includes one or more Group V base stocks each having a kinematic viscosity of less than 50 cSt at 100° C., or less than 33 cSt, or less than 15 St at 100° C. In another embodiment, at least one of the Group V base stocks of the Group V base oil component has kinematic viscosity of less than 50 cSt at 100° C., or less than 33 cSt, or less than 15 cSt at 100° C.

The kinematic viscosity of the Group V base oil component is intended to refer to the kinematic viscosity of the total content of the Group V base stocks that make up the Group V base oil component, with the kinematic viscosity of the Group V base oil component being determined prior to blending with the other components of the lubricating composition. The kinematic viscosity can be measured according to ASTM D445-10 Standard Test Method for Kinematic Viscosity of Transparent and Opaque Liquids (and Calculation of Dynamic Viscosity).

In one embodiment, the Group V base oil component of the lubricating composition has a viscosity index of from 60 to 160, or from 75 to 145, or from 85 to 135. In one embodiment, at least one of the Group V base stocks of the Group V base oil component have a viscosity index of from 60 to 160. In another embodiment, each of the Group V base stocks of the Group V base oil component has a viscosity index of from 60 to 160. The viscosity index can be measured according to the ASTM D2270 Standard Test Method.

In one embodiment, the Group V base oil component is sufficiently high in polarity to affect the solubility with the Group IV base oil component. In general, polarity can be quantified by aniline point, such as according to ASTM D611-07 Standard Test Methods for Aniline Point and Mixed Aniline Point of Petroleum Products and Hydrocarbon Solvents. Lower aniline point indicates higher polarity, and higher aniline point indicates lower polarity.

In one embodiment of the invention, the Group V base oil component of the lubricating composition of the invention has an aniline point of at least −5° C., alternatively an aniline point of at least 0° C., or at least 10° C., or at least 20° C., or at least 40° C., or at least 60° C.

In one embodiment, the Group V base oil component has a relatively low hygroscopicity. Hygroscopicity is generally the capacity of a composition to absorb moisture from air. Hygroscopicity of the Group V base oil component of the lubricating composition can be measured after exposure to air under conditions of 80% relatively humidity at one (1) atmosphere and 20° C. for 16 days. The Group V base oil component is evaluated under the stated conditions after 16 days according to ASTM E203-08 Standard Test Method for Water Using Volumetric Karl Fischer Titration.

In one embodiment, the hygroscopicity of the Group V base oil component of this invention will be less than that of glycol. For example, the hygroscopicity of the Group V base oil component of this invention can be not greater than 10,000 ppm or not greater than 5,000 ppm, or not greater than 1,000 ppm, or not greater than 500 ppm.

In one embodiment, the Group V base oil component has a specific gravity of from 0.750 g/cm$^3$ to 0.960 g/cm$^3$, or from 0.810 g/cm$^3$ to 0.940 g/cm$^3$, or from 0.880 g/cm$^3$ to 0.920 g/cm$^3$. The specific gravity is measured according to the ASTM D4052 standard test method.

In one embodiment, Group V base oil component has a pour point of lower than −5° C., or lower than −15° C., or lower than −30° C. The pour point can be measured according to the ASTM D5950, D97, D5949, or D5985 standard test method.

III. Group IV Base Oil Component

The lubricating composition of this invention comprises a Group IV base oil component that mixes well with the Group V base oil component. The combination of the Group IV base oil component and the Group V base oil component provide a high quality lubricating composition, without having to use substantial quantities of non-base stock additives, in addition the trithiophosphate-containing compound.

The Group IV base oil component can include one or more Group IV base stocks, such as one or more polyalphaolefin base stocks. The Group IV base oil component can be comprised of a single type of Group IV base stock, such as a metallocene derived polyalphaolefin base stock, or as a blend of different types of Group IV base stocks such as a blend of a metallocene derived polyalphaolefin base stock and a non-metallocene derived polyalphaolefin base stock.

The lubricating composition is produced from a blend of components comprising at least 30 wt. % of the Group IV base oil component, based on total weight of the blend components of the lubricating composition. In other words, the Group IV base oil component has a blend concentration of at least 30 wt. %, based on total weight of the blend components used to produce the lubricating composition. In another embodiment, the lubricating composition includes at least 40 wt. % of the of the Group IV base oil component, or at least 65 wt. % of the Group IV base oil component.

In one embodiment, the lubricating composition includes not greater than 95 wt. % of the Group IV base oil component, or not greater than 90 wt. %, or not greater than 80 wt. % of the Group IV base oil component, based on the total weight of the blend components used to produce the lubricating composition.

Examples of the ranges of the amount of Group IV base oil component that can be blended with the other components of the lubricating composition include from 30 wt. % to 95 wt. %, or from 40 wt. % to 90 wt. % of the Group IV base oil component, or from 55 wt. % to 85 wt. %, or from 60 wt. % to 80 wt. % of the Group IV base oil component, based on total weight of the blend components used to produce the lubricating composition.

The Group IV base oil component of the lubricating composition of this invention is preferably a liquid polyalphaolefin composition. The polyolefin can be obtained by polymerizing at least one monomer, e.g., 1-olefin, in the presence of hydrogen and a catalyst composition.

Alpha-olefins suitable for use in the preparation of the saturated, liquid polyalphaolefin polymers described herein contain from 2 to about 30, preferably from 2 to 20, carbon atoms, and more preferably from about 6 to about 12 carbon atoms. Non-limiting examples of such alpha-olefins include ethylene, propylene, 2-methylpropene, 1-butene, 3-methyl-1-butene, 1-pentene, 4-methyl-1-pentene, 1-hexene, 1-heptene, 1-octene, 1-nonene, 1-decene, 1-undecene, 1-dodecene, 1-tridecene, 1-tetradecene, 1-pentadecene, 1-hexadecene, 1-heptadecene, 1-octadecene, 1-nonadecene, and 1-eicosene, including mixtures of at least two of the alpha-olefins. Preferred alpha-olefins for use herein are 1-octene, 1-decene and 1-dodecene, including mixtures thereof.

Specifically, the polyalphaolefins (PAOs) that can be used according to this invention can be produced by polymerization of olefin feed in the presence of a catalyst such as $AlCl_3$, $BF_3$, or promoted $AlCl_3$, $BF_3$. Processes for the production of such PAOs are disclosed, for example, in the following patents: U.S. Pat. Nos. 3,149,178; 3,382,291; 3,742,082; 3,769,363; 3,780,128; 4,172,855 and 4,956,122, which are fully incorporated by reference. Additional PAOs are also discussed in: Will, J. G. *Lubrication Fundamentals*, Marcel Dekker: New York, 1980. Subsequent to polymerization, the PAO lubricating composition range products are typically hydrogenated in order to reduce the residual unsaturation, generally to a level of greater than 90% of hydrogenation.

PAOs that can be used according to the invention can be produced by polymerization of an alpha-olefin in the presence of a polymerization catalyst such as Friedel-Crafts catalysts. These include, for example, boron trichloride, aluminum trichloride, or boron trifluoride, promoted with water, with alcohols such as ethanol, propanol, or butanol, with carboxylic acids, or with esters such as ethyl acetate or ethyl propionate or ether such as diethyl ether, diisopropyl ether, etc. (See for example, the methods disclosed by U.S. Pat. No. 4,149,178 or 3,382,291.) Other descriptions of PAO synthesis are found in the following patents: U.S. Pat. No. 3,742,082 (Brennan); U.S. Pat. No. 3,769,363 (Brennan); U.S. Pat. No. 3,876,720 (Heilman); U.S. Pat. No. 4,239,930 (Allphin); U.S. Pat. No. 4,367,352 (Watts); U.S. Pat. No. 4,413,156 (Watts); U.S. Pat. No. 4,434,408 (Larkin); U.S. Pat. No. 4,910,355 (Shubkin); U.S. Pat. No. 4,956,122 (Watts); and U.S. Pat. No. 5,068,487 (Theriot).

A class of HVI-PAOs that can be incorporated as a part of this invention can be prepared by the action of a supported, reduced chromium catalyst with an alpha-olefin monomer. Such PAOs are described in U.S. Pat. No. 4,827,073 (Wu); U.S. Pat. No. 4,827,064 (Wu); U.S. Pat. No. 4,967,032 (Ho et al.); U.S. Pat. No. 4,926,004 (Pelrine et al.); and U.S. Pat. No. 4,914,254 (Pelrine). Commercially available PAOs include SpectraSyn Ultra™ 300 and SpectraSyn Ultra™ 1000. (ExxonMobil Chemical Company, Houston, Tex.).

PAOs made using metallocene catalyst systems can also be used according to this invention. In one embodiment, at least one of the base stocks of the Group IV base oil component is a reaction product of a metallocene catalyst and at least one linear alpha-olefin. In another embodiment, each of the base stocks of the Group IV base oil component is a reaction product of a metallocene catalyst and at least one linear alpha-olefin. In yet another embodiment, the Group IV base oil component is a reaction product of a metallocene catalyst and at least one linear alpha-olefin.

Examples are described in U.S. Pat. No. 6,706,828 (equivalent to US 2004/0147693), where PAOs having Kv 100 s of greater than 1000 cSt are produced from meso-forms of certain metallocene catalysts under high hydrogen pressure with methyl alumoxane as a activator.

PAOs, such as polydecene, using various metallocene catalysts can also be incorporated into the lubricating composition of this invention. Examples of how such PAOs can be produced are described, for example, in WO 96/23751, EP 0 613 873, U.S. Pat. No. 5,688,887, U.S. Pat. No. 6,043,401, WO 03/020856 (equivalent to US 2003/0055184), U.S. Pat. No. 5,087,788, U.S. Pat. No. 6,414,090, U.S. Pat. No. 6,414,091, U.S. Pat. No. 4,704,491 U.S. Pat. No. 6,133,209, and U.S. Pat. No. 6,713,438.

The kinematic viscosity of the Group IV base oil component may depend on the particular use of the lubricating composition. The kinematic viscosity of the base oil component is intended to refer to the kinematic viscosity of the total content of the Group IV base stocks that make up the Group IV base oil component, with the kinematic viscosity of Group IV base oil component being determined prior to blending with the other components of the lubricating composition of this invention. In one embodiment, the kinematic viscosity of the Group IV base oil component is not greater than 2,000 cSt at 100° C. (Kv 100), or not greater than 600 cSt, or not greater than 300 cSt, or not greater than 100 cSt at 100° C.

In another embodiment, the kinematic viscosity of the Group IV base oil component is at least 2 cSt, or at least 4 cSt, or at least 20 cSt at 100° C.

In another embodiment, the kinematic viscosity of the Group IV base oil component is from 2 cSt to 2,000 cSt, or from 20 cSt to 1,000 cSt, or from 35 cSt to 800 cSt at 100° C.

In one embodiment, the Group IV base oil component comprises one or more Group IV base stocks, and each of the Group IV base stocks have a kinematic viscosity of not greater than 2,000 cSt, or not greater than 600 cSt, or not greater than 300 cSt, or not greater than 100 cSt at 100° C. In another embodiment, at least one of the Group IV base stocks of the Group IV base oil component has a kinematic viscosity of not greater than 2,000 cSt, or not greater than 600 cSt, or not greater than 300 cSt, or not greater than 100 cSt at 100° C.

In another embodiment, at least one of the Group IV base stocks of the Group IV base oil component has a kinematic viscosity of at least 2 cSt, or at least 4 cSt, or at least 20 cSt at 100° C. In yet another embodiment, each of the Group IV base stocks of the Group IV base oil component have a kinematic viscosity of at least 2 cSt, or at least 4 cSt, or at least 20 cSt at 100° C.

In yet another embodiment, at least one of the Group IV base stocks of the Group IV base oil component has a kinematic viscosity of from 2 cSt to 2,000 cSt, or from 20 cSt to 1,000 cSt, or from 35 cSt to 800 cSt at 100° C. In one embodiment, the Group IV base oil component comprises one or more Group IV base stocks, and each of the Group IV base stocks have a kinematic viscosity of from 2 cSt to 2,000 cSt, or from 20 cSt to 1,000 cSt, or from 35 cSt to 800 cSt at 100° C.

In one embodiment, the Group IV base oil component comprises a blend of two polyalphaolefin base stocks having different kinematic viscosities. In one preferred embodiment, the Group IV base oil component includes a first polyalphaolefin base stock having a kinematic viscosity of from 2 cSt to 10 cSt, preferably 4 cSt at 100° C., and a second polyalphaolefin base stock having a kinematic viscosity of from 25 cSt to 55 cSt, preferably 40 cSt at 100° C.

The kinematic viscosity can be measured according to ASTM D445-10 Standard Test Method for Kinematic Viscosity of Transparent and Opaque Liquids (and Calculation of Dynamic Viscosity).

In one embodiment of the invention, the Group IV base oil component of this invention has a $M_w$ (weight average molecular weight) of about 200,000 g/mol or less, preferably from about 250 to 200,000, alternatively from about 280 to 150,000, or from about 300 to about 100,000 g/mol.

In another embodiment, the Group IV base oil component has a $M_w/M_n$ (molecular weight distribution or MWD) of greater than 1 and less than 5, preferably less than 4, preferably less than 3, preferably less than 2.5, preferably less than 2. Alternatively, Group IV base oil component has a $M_w/M_n$ of from 1 to 3.5, alternatively from 1 to 2.5.

In one embodiment, the Group IV base oil component has a unimodal $M_w/M_n$ determined by size exclusion or gel permeation chromatograph. In another embodiment, the Group IV base oil component has a multi-modal molecular weight distribution, where the MWD can be greater than 5. In another aspect, the Group IV base oil component has a shoulder peak either before or after, or both before and after the major unimodal distribution. In this case, the MWD can be broad (>5) or narrow (<5 or <3 or <2), depending on the amount and size of the shoulder.

For many applications when superior shear stability, thermal stability or thermal/oxidative stability is preferred, it is preferable to have the polyolefins made with the narrowest possible MWD. PAO fluids with different viscosities, but made from the same feeds or catalysts, usually have different MWDs. In other words, MWDs of PAO fluids are dependent on fluid viscosity. Usually, lower viscosity fluids have narrower MWDs (smaller MWD value) and higher viscosity fluids have broader MWDs (larger MWD value). For a Group IV base oil component with a Kv 100 of less than 1000 cSt, the MWD of is preferably less than 2.5, and typically around 2.0±0.5. A Group IV base oil component with a 100° C. viscosity greater than 1000 cSt can have broader MWDs, usually greater than 1.8.

Molecular weight distribution (MWD), defined as the ratio of weight-averaged MW to number-averaged MW (=Mw/Mn), can be determined by gel permeation chromatography (GPC) using polystyrene standards, as described in p. 115 to 144, Chapter 6, The Molecular Weight of Polymers in "Principles of Polymer Systems" (by Ferdinand Rodrigues, McGraw-Hill Book, 1970). The GPC solvent was HPLC Grade tetrahydrofuran, uninhibited, with a column temperature of 30° C., a flow rate of 1 ml/min, and a sample concentration of 1 wt %, and the Column Set is a Phenogel 500 A, Linear, 10E6A.

PAOs made using metallocene catalyst systems may have a substantially minor portion of a high end tail of the molecular weight distribution. Preferably, these PAOs have not more than 5.0 wt % of polymer having a molecular weight of greater than 45,000 Daltons. Additionally or alternately, the amount of the PAO that has a molecular weight greater than 45,000 Daltons is not more than 1.5 wt %, or not more than 0.10 wt %. Additionally or alternately, the amount of the PAO that has a molecular weight greater than 60,000 Daltons is not more than 0.5 wt %, or not more than 0.20 wt %, or not more than 0.1 wt %. The mass fractions at molecular weights of 45,000 and 60,000 can be determined by GPC, as described above.

In a preferred embodiment of this invention, the Group IV base oil component has a pour point of less than 25° C. (as measured by ASTM D 97), preferably less than 0° C., preferably less than −10° C., preferably less than −20° C., preferably less than −25° C., preferably less than −30° C., preferably less than −35° C., preferably less than −40° C., preferably less than −55° C., preferably from −10° C. to −80° C., preferably from −15° C. to −70° C.

Preferably, the Group IV base oil component has a peak melting point ($T_m$) of 0° C. or less, and preferably has no measurable Tm. "No measurable Tm" is defined to be when there is no clear melting as observed by heat absorption in the DSC heating cycle measurement. Usually the amount of heat absorption is less than 20 J/g. It is preferred to have the heat release of less than 10 J/g, preferred less than 5 J/g, more preferred less than 1 J/g. Usually, it is preferred to have lower melting temperature, preferably below 0° C., more preferably below −10° C., more preferably below −20° C., more preferably below −30° C., more preferably below −40° C., most preferably no clear melting peak in DSC.

Peak melting point ($T_m$), crystallization temperature ($T_c$), heat of fusion and degree of crystallinity (also referred to as % crystallinity) can be determined using the following procedure. Differential scanning calorimetric (DSC) data is obtained using a TA Instruments model 2920 machine. Samples weighing approximately 7-10 mg are sealed in aluminum sample pans. The DSC data can be recorded by first cooling the sample to −100° C., and then gradually heating to 30° C. at a rate of 10° C./minute. The sample can be kept at 30° C. for 5 minutes before a second cooling-heating cycle is applied. Both the first and second cycle thermal events should be recorded. Areas under the curves are preferably measured and used to determine the heat of fusion and the degree of crystallinity. Additional details of such procedure are described in US Patent Pub. No. 2009/0036725.

In one embodiment of the invention, the Group IV base oil component is preferred to have no appreciable cold crystallization in DSC measurement. During the heating cycle for the DSC method as described above, the PAO may crystallize if it has any crystallizable fraction. This cold crystallization can be observed on the DSC curve as a distinct region of heat release. The extent of the crystallization can be measured by the amount of heat release. Higher amount of heat release at lower temperature means higher degree of poor low temperature product. The cold crystallization is usually less desirable, as it may mean that the fluid may have very poor low temperature properties—not suitable for high performance application. It is preferred to have less than 20 j/g of heat release for this type of cold crystallization, preferred less than 10 j/g, less than 5 j/g and less than 1 j/g. It is most preferable to have no observable heat release due to cold crystallization during DSC heating cycle.

In another preferred embodiment, the Group IV base oil component will have a viscosity index (VI) of greater than 60, preferably greater than 100, more preferably greater than 120, preferably at least 130 or at least 180. VI is determined according to ASTM Method D 2270-93 (1998). VI of a fluid is usually dependent on the viscosity, feed composition and method of preparation. Higher viscosity fluid of the same feed composition usually has higher VI. The typical VI range for fluids made from $C_3$ or $C_4$ or $C_5$ linear alpha-olefin (LAO) will typically be from 65 to 250. Typical VI range for fluids made from $C_6$ or $C_7$ will be from 100 to 300, depending on fluid viscosity. Typical VI range for fluids made from $C_8$ to $C_{14}$ LAO, such as 1-octene, 1-nonene, 1-decene or 1-undecene or 1-dodecene, 1-tetra-decene, are from 120 to >450, depending on viscosity. More specifically, the VI range for fluids made from 1-decene or 1-decene equivalent feeds are from about 100 to about 500, preferably from about 120 to about 400. Two or three or more alpha-olefins can be used as feeds, such as combination of $C_3+C_{10}$, $C_3+C_{14}$, $C_3+C_{16}$, $C_3+Cl_8$, $C_4+C_8$, $C_4+Cl_2$, $C_4+C_{16}$, $C_3+C_4+C_8$, $C_3+C_4+C_{12}$, $C_4+C_{10}+Cl_{29}$ $C_4+C_{10}+C_{14}$, $C_6+C_{12}$, $C_6+C_{12}+C_{14}$, $C_4+C_6+C_{10}+C_{14}$, $C_4+C_6+C_8+C_{10}+C_{12}+C_{14}+C_{16}+C_{18}$, etc. The product VI depends on the fluid viscosity and also on the choice of feed olefin composition. For the most demanding lubricant applications, it is better to use fluids with higher VI.

In another embodiment, it is preferable that the Group IV base oil component, such as a PAO base oil, does not contain a significant amount of very light fraction. These light fractions contribute to high volatility, unstable viscosity, poor oxidative and thermal stability. They are usually removed in the final product. It is generally preferable to have less than 5 wt. % of the Group IV base oil component with $C_{20}$ or lower carbon numbers, based on the total weight of the Group IV base oil component, more preferably less than 10 wt. % of the Group IV base oil with $C_{24}$ or lower carbon numbers or more preferably less than 15 wt. % of the Group IV base oil with $C_{26}$ or lower carbon numbers. It is preferable to have less than 3 wt. % of the Group IV base oil with $C_{20}$ or lower carbon numbers, more preferably less than 5 wt. % of the Group IV base oil with $C_{24}$ or lower carbon numbers or more preferably less than 8 wt. % of the Group IV base oil with $C_{26}$ or lower carbon numbers. It is preferable to have less than 2 wt. % of the Group IV base oil with $C_{20}$ or lower carbon numbers, more preferably less than 3 wt. % of the Group IV base oil with $C_{24}$ or lower carbon numbers or more preferably less than 5 wt. % of the Group IV base oil with $C_{26}$ or lower carbon numbers. Also, the lower the amount of any of these light hydrocarbons, the better the fluid property of the Group IV base oil component as can be determined by Noack volatility testing (ASTM D5800).

In general, Noack volatility is a strong function of fluid viscosity. Lower viscosity fluid usually has higher volatility and higher viscosity fluid has lower volatility. Preferably, the Group IV base oil component has a Noack volatility of less than 30 wt. %, preferably less than 25 wt. %, preferably less than 10 wt. %, preferably less than 5 wt. %, preferably less than 1 wt. %, and preferably less than 0.5 wt. %.

In another embodiment, the Group IV base oil component has a dielectric constant of 3 or less, usually 2.5 or less (1 kHz at 23° C., as determined by ASTM D 924).

In another embodiment, the Group IV base oil component can have a specific gravity of 0.6 to 0.9 g/cm$^3$, or 0.7 to 0.8 g/cm$^3$.

In another embodiment, the PAOs produced directly from the oligomerization or polymerization process are unsaturated olefins. The amount of unsaturation can be quantitatively measured by bromine number measurement according to the ASTM D 1159, or by proton or carbon-13 NMR. Proton NMR spectroscopic analysis can also differentiate and quantify the types of olefinic unsaturation: vinylidene, 1,2-disubstituted, trisubstituted, or vinyl. Carbon-13 NMR spectroscopy can confirm the olefin distribution calculated from the proton spectrum.

Both proton and carbon-13 NMR spectroscopy can quantify the extent of short chain branching (SCB) in the olefin oligomer, although carbon-13 NMR can provide greater specificity with respect to branch lengths. In the proton spectrum, the SCB branch methyl resonances fall in the 1.05-0.7 ppm range. SCBs of sufficiently different length will give methyl peaks that are distinct enough to be integrated separately or deconvoluted to provide a branch length distribution. The remaining methylene and methine signals resonate in the 3.0-1.05 ppm range. In order to relate the integrals to CH, $CH_2$, and $CH_3$ concentrations, each integral must be corrected for the proton multiplicity. The methyl integral is divided by three to derive the number of methyl groups; the remaining aliphatic integral is assumed to comprise one CH signal for each methyl group, with the remaining integral as $CH_2$ signal. The ratio of $CH_3/(CH+CH_2+CH_3)$ gives the methyl group concentration.

Similar logic applies to the carbon-13 NMR analysis, with the exception that no proton multiplicity corrections need be made. Furthermore, the enhanced spectral/structural resolution of $^{13}C$ NMR vis a vis $^1H$ NMR allows differentiation of ions according to branch lengths. Typically, the methyl resonances can be integrated separately to give branch concentrations for methyls (20.5-15 ppm), propyls (15-14.3 ppm), butyl-and-longer branches (14.3-13.9 ppm), and ethyls (13.9-7 ppm).

Olefin analysis is readily performed by proton NMR, with the olefinic signal between 5.9 and 4.7 ppm subdivided according to the alkyl substitution pattern of the olefin. Vinyl group CH protons resonate between 5.9-5.7 ppm, and the vinyl $CH_2$ protons between 5.3 and 4.85 ppm. 1,2-disubstituted olefinic protons resonate in the 5.5-5.3 ppm range. The trisubstituted olefin peaks overlap the vinyl $CH_2$ peaks in the 5.3-4.85 ppm region; the vinyl contributions to this region are removed by subtraction based on twice the vinyl CH integral. The 1,1-disubstituted- or vinylidene-olefins resonate in the 4.85-4.6 ppm region. The olefinic resonances, once corrected for the proton multiplicities can be normalized to give a mole-percentage olefin distribution, or compared to the multiplicity-corrected aliphatic region (as was described above for the methyl analysis) to give fractional concentrations (e.g. olefins per 100 carbons).

Generally, the amount of unsaturation strongly depends on fluid viscosity or fluid molecular weight. Lower viscosity fluid has higher degree of unsaturation and higher bromine number. Higher viscosity fluid has lower degree of unsaturation and lower bromine number. If a large amount of hydrogen or high hydrogen pressure is applied during the polymerization step, the bromine number can be lower than without the hydrogen presence. Typically, for greater than 300 cSt to 6000 cSt polyalphaolefin produced from 1-decene or other suitable LAOS, the as-synthesized PAO will have bromine number of from 60 to less than 1, but greater than 0, preferably from about 30 to about 0.01, preferably from about 10 to about 0.5, depending on fluid viscosity.

IV. Trithiophosphate-Containing Compound

The lubricating composition comprises 0.25 wt. % to 1.5 wt. % of the trithiophosphate-containing compound to provide improved oxidation stability, improved antioxidation performance, and thus extended oil drain life. The trithiophosphate-containing compound significantly contributes to the improved antioxidation performance of the lubricating composition. The lubricating composition provides equal to or better oxidation stability, relative to other lubricating compositions including greater amounts of other antioxidant additives. Antioxidant additives are components than have been used to provide oxidation stability. An advantage of the blended lubricating composition is a lower amount of the trithiophosphate-containing compound, relative to the amount of other antioxidant additives that have been used in other lubricating compositions.

The trithiophosphate-containing compound is used in the lubricating composition as an antioxidant, instead of antioxidant additives of the prior art, such as those of U.S. Pat. No. 6,180,575 to Nipe, discussed above. The trithiophosphate-containing compound provides improved antioxidation performance by preventing damage of the equipment in which the lubricating composition is used. The trithiophosphate-containing compound retards the oxidative degradation of the blended lubricating composition during service. Such degradation may result in deposits on metal surfaces, the presence of sludge, or a viscosity increase in the lubricating composition.

The lubricating composition includes the trithiophosphate-containing compound in an amount of from 0.25 wt. % to 1.5 wt. %, based on total weight of the lubricating composition. In another embodiment, the lubricating composition includes the trithiophosphate-containing compound in an amount of from 0.7 wt. % to 1.3 wt. %, or from 0.8 wt. % to 1.2 wt. %.

In one embodiment, the lubricating composition includes the trithiophosphate-containing compound in an amount of at least 0.5 wt. %, based on total weight of the lubricating composition, or at least 0.6 wt. %, or at least 0.7 wt. %, or at least 0.8 wt. %, or at least 0.9 wt. %, or at least 1.0 wt. %.

In one embodiment, the lubricating composition includes the trithiophosphate-containing compound in an amount not greater than 1.5 wt. %, based on total weight of the lubricating composition, or not greater than 1.3 wt. %, or not greater than 1.2 wt. %, or not greater than 1 wt. %.

In one embodiment, the trithiophosphate-containing compound has the following structure:

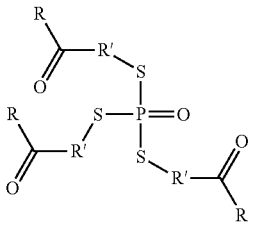

wherein each substituent R group is independently selected from a linear or branched alkoxy or amine functionality, and each substituent R' group is independently selected from —$CH_2$—, —$CH_2CH_2$—, and —$CH(CH_3)$—.

In one embodiment, the trithiophosphate-containing compound has a molecular weight of 600 to 700, or 620 to 680, or 630 to 655 g/mol. In another embodiment, the trithiophosphate-containing compound has a molecular weight of at least 605, or at least 625, or at least 635 g/mol.

In one embodiment, the trithiophosphate-containing compound has a molecular weight of not greater than 715, or not greater than 690, or not greater than 685 g/mol.

In one embodiment, the trithiophosphate-containing compound has a molecular weight of 600 to 700, or 620 to 685, or 620 to 670 g/mol.

In one preferred embodiment, the trithiophosphate-containing compound S,S,S-Tris-carbo-2-isooctyloxy-methyl trithiophosphate has the chemical formula $C_{30}H_{57}O_7PS_3$ and the following structure:

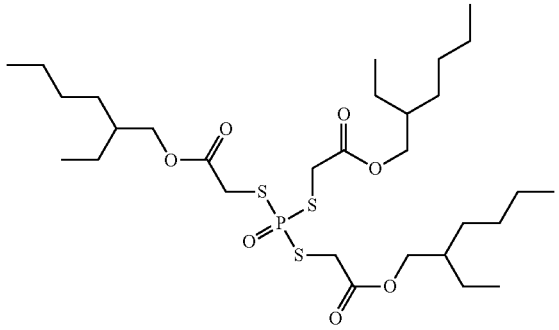

Other examples of the trithiophosphate-containing compound are disclosed in U.S. Pat. No. 4,197,209 to Zinke et al.

In one embodiment, the trithiophosphate-containing compound is provided in a blend along with at least one other component, and then that blend is added to the Group V base oil component and the Group IV base oil component, and then mixed together. For example, the trithiophosphate-containing compound can be provided in a blend comprising the trithiophosphate-containing compound and an alkylated amine.

V. Alkylated Amine

The lubricating composition includes an optional amount of an alkylated amine. The alkylated amine is typically produced by reacting an alkyl halide, alcohol, and ammonia or an amine. In one embodiment, the alkylated amine is an aromatic amine, including N, NH, or $NH_2$ attached to an aromatic hydrocarbon. In one embodiment, the aromatic amine is alkylated diphenyl amine $(C_6H_5)_2NH$. In another embodiment, the alkylated amine is alkylated phenyl alpha naphthyl amine.

In one embodiment, the lubricating composition comprises 0.25 wt. % to 1.5 wt. % alkylated amine, based on total weight of the blend components used to produce the lubricating composition. In another embodiment, the lubricating composition comprises at least 0.5 wt. % alkylated amine, based on total weight of the lubricating composition, or at least 0.6 wt. %, or at least 0.7 wt. %, or at least 0.8 wt. %, or at least 0.9 wt. %, or at least 1.0 wt. % of an alkylated amine, based on total weight of the blend components used to produce the lubricating composition.

In one embodiment, the lubricating composition comprises not greater than 1.5 wt. % alkylated amine. In another embodiment, the lubricating composition comprises not greater than 1.3 wt. % alkylated amine, or not greater than 1.2 wt. %, or not greater than 1 wt. % of alkylated amine.

In one embodiment, the lubricating composition includes 0.25 wt. % to 1.5 wt. % trithiophosphate-containing compound and 0.25 wt. % to 1.5 wt. % alkylated diphenyl amine. In another embodiment, the lubricating composition includes 0.7 wt. % to 1.3 wt. %, or 0.8 wt. % to 1.2 wt. % trithiophosphate-containing compound, and 0.7 wt. % to 1.3 wt. %, or 0.8 wt. % to 1.2 wt. % alkylated diphenyl amine, based on total weight of the blend components used to produce the lubricating composition.

In one embodiment, the lubricating composition includes at least 0.25 wt. % trithiophosphate-containing compound and at least 0.25 wt. % alkylated diphenyl amine. In another embodiment, the lubricating composition includes at least 0.85 wt. % trithiophosphate-containing compound and at least 0.85 wt. % alkylated diphenyl amine, or at least 1 wt. % trithiophosphate-containing compound and at least 1 wt. % alkylated diphenyl amine, based on total weight of the blend components used to produce the lubricating composition.

In one embodiment, the lubricating composition includes not greater than 1.5 wt. % trithiophosphate-containing compound and not greater than 1.5 wt. % alkylated diphenyl amine. In another embodiment, the lubricating composition includes not greater than 1 wt. % trithiophosphate-containing compound and not greater than 1 wt. % alkylated diphenyl amine, or not greater than 0.9 wt. % trithiophosphate-containing compound and not greater than 0.9 wt. % alkylated diphenyl amine, based on total weight of the blend components used to produce the lubricating composition.

In one alternate embodiment, the trithiophosphate-containing compound and the alkylated diphenyl amine are present in different amounts, such as from 1 wt. % to 1.5 wt. % trithiophosphate-containing compound and from 0.5 wt. % to 0.9 wt. % alkylated diphenyl amine.

As alluded to above, in one embodiment, the trithiophosphate-containing compound can be provided in a commercially available blend comprising the trithiophosphate-containing compound and an alkylated amine. For example a blend of 50 wt. % trithiophosphate-containing compound, such as S,S,S-Tris-carbo-2-isooctyloxy-methyl trithiophosphate, and 50 wt. % alkylated amine, such as alkylated diphenyl amine, can be provided and then blended with the base oil components. However, the alkylated amine and the trithiophosphate-containing compound can be provided independent of one another, and then independently blended with the base oil components.

In an alternative embodiment, the trithiophosphate-containing compound is optionally provided in a blend comprising another component, instead of or in addition to the alkylated amine. For example, the blend could include at least one other amine, ester, or phenol, such as a hindered phenol ester, or methylene-bis-hindered phenol.

VI. Group I, Group II, or Group III Base Oil Component

The lubricating composition preferably includes little to no Group I, Group II, or Group III base oil component. In one preferred embodiment, the lubricating composition is a Group IV/Group V lubricating composition, which means the lubricating composition includes little to no no Group I, Group II, or Group III base oil component. As discussed above, the API Group I, API Group II and API Group III base stocks are broad categories of base stocks, defined by the American Petroleum Institute (API Publication 1509; www.API.org), which creates guidelines for lubricant base oils.

The lubricating composition comprises not greater than 5 wt. % of a Group I, Group II, or Group III base oil component, based on the total weight of the blend components used to produce the lubricating composition. Preferably, the lubricating composition comprises not greater than 4 wt. %, preferably not greater than 3 wt. %, more preferably not greater than 1 wt. %, and most preferably 0 wt. % of the Group I, Group II, or Group III base oil component, based on total weight of the blend components of the lubricating composition.

VII. Heavy Metal Component

As stated above, the lubricating composition preferably includes little to no heavy metal component, such as zinc. Heavy metals have been effective in providing improved anti-oxidation performance in lubricating compositions. However, lubricating compositions including such metals can cause deposits on machinery in which the lubricating composition is used, particularly at high operating temperatures. Further, lubricating compositions including heavy metals are regulated in some parts of the world, and typical manufacturing standards limit the amount of heavy metals in a lubricating composition to not greater than 50 ppm.

The heavy metal component includes at least one transition metal, or at least one alkali earth metal, as defined in the periodic table. The heavy metal component can include a blend of one or more alkali earth metals, one or more transition metals, or one or more alkali earth metals and one or more transition metals. The heavy metal component includes one or more elements selected from the group consisting of a Group 2 element, a Group 4 element, a Group 5 element, a Group 6 element, a Group 7 element, a Group 8 element, a Group 9 element, a Group 10 element, a Group 11 element, and a Group 12 element.

Group 2 elements include Be, Mg, Ca, Sr, Ba, and Ra. Group 3 elements include Sc and Y. Group 4 elements include Ti, Zr, Hf, and Rf. Group 5 elements include V, Nb, Ta, and Db. Group 6 elements include Cr, Mo, W and Sg. Group 7 elements include Mn, Tc, Re, and Bh. Group 8 elements include Fe, Ru, Os, and Hs. Group 9 elements include Co, Rh, Ir, and Mt. Group 10 elements include Ni, Pd, Pt, and Ds. Group 11 elements include Cu, Ag, Au, and Rg. Group 12 elements include Zn, Cd, Hg, and Cn.

In one embodiment, the lubricating composition includes not greater than 45 ppm of the heavy metal component, or not greater than 10 ppm, more preferably not greater than 5 ppm, and most preferably 0 ppm of the heavy metal component, based on the total weight of the blend components used to produce the lubricating composition.

VIII. Blended Lubricating Composition

The lubricating composition is prepared by blending together one or more of the Group V base stocks to produce the Group V base oil component. One or more of the Group IV base stocks can be blended together to produce the Group IV base oil component. The base oil components can then be blended together. Blending can, however, be done in any order, including any additional amount of components that may be desired.

The blended lubricating composition can be used as a general industrial oil or lubricant, a grease, a hydraulic fluid or lubricant, a heat transfer fluid, or an insulating fluid.

Lubricating compositions for industrial applications are typically classified according to the ISO Viscosity Classification System, approved by the International Standards Organization (ISO). Each ISO viscosity grade number corresponds to the mid-point of a viscosity range expressed in centistokes (cSt) at 40° C. For example, a lubricating composition with an ISO grade of 32 has a viscosity within the range of 28.8 to 35.2, the midpoint of which is 32. In one embodiment, the blended lubricating composition has a kinematic viscosity of from 20 cSt to 1000 cSt at 40° C. and corresponding ISO VG grade of 22 to 1000 and is used in an industrial application. In another embodiment, the blended lubricating composition has an ISO viscosity grade of 150 to 1000 and thus is acceptable for use in industrial gear applications.

In one embodiment, the blended lubricating composition includes a blend of high quality base stocks in an amount such that there is less need for additive components, in addition to the trithiophosphate-containing compound. In one embodiment, the blended lubricating composition includes a total of at least 50 wt. %, or at least 65 wt. %, or at least 80 wt. %, or at least 90 wt. % of the combined Group V base oil component and the Group IV base oil component, based on the total weight of the blend components used to produce the lubricating composition.

In one embodiment, the blended lubricating composition includes a total of not greater than 99 wt. %, or not greater than 95 wt. %, or not greater than 90 wt. % of the combined Group V base oil component and the Group IV base oil component, based on the total weight of the blend components used to produce the lubricating composition.

In one embodiment, the blended lubricating composition includes a total of from 50 wt. % to 95 wt. %, or from 65 wt. % to 95 wt. %, or from 80 wt. % to 95 wt. % of the combined Group V base oil component and the Group IV base oil component, based on the total weight of the blend components used to produce the lubricating composition.

In one embodiment, the blended lubricating composition comprises from 10 wt. % to 30 wt. % of the Group V base oil component and from 70 wt. % to 90 wt. % of the Group IV base oil component, based on total weight of the blend components of the lubricating composition. In another embodiment, the blended lubricating composition comprises from 10 wt. % to 20 wt. % of the Group V base oil component and from 70 wt. % to 90 wt. % of the Group IV base oil component, based on total weight of the blend components of the lubricating composition. In yet another embodiment, the blended lubricating composition comprises from 15 wt. % to 25 wt. % of the Group V base oil component and from 70 wt. % to 85 wt. % of the Group IV base oil component, based on total weight of the blend components of the lubricating composition.

As stated above, the trithiophosphate-containing compound is added to the blended base oil components to provide a lubricating composition with improved antioxidation performance. The high quality base stocks are present in an amount sufficient such that there is less need for other performance enhancing additives, which can affect at least one property or characteristic of the blended lubricating composition, or affect the performance of the blended lubricating composition during use.

Less need for performance additives is beneficial because certain levels of additives can cause problems in lubricating compositions. The blended lubricating composition optionally includes one or more performance additives in a total amount not greater than 10 wt. %, and preferably not greater than 5 wt. %, based on the total weight of the blend components used to produce the lubricating composition. In one embodiment, the blended lubricating composition includes one or more performance additives in a total amount of 2.5 wt. %, in addition to the trithiophosphate-containing compound and the alkylated amine.

Examples of performance additives useful in the blended lubricating compositions include defoamants, anti-wear/extreme pressure additives, and corrosion inhibitors.

Defoamants include polymers of alkyl methacrylate where alkyl is generally understood to be methyl, ethyl, propyl, isopropyl, butyl, or iso butyl; and polymers of dimethylsilicone in the viscosity range of 100 cSt to 100,000 cSt. Other defoamants, such as silicone polymers which have been post reacted with various carbon containing moieties, are widely used. Organic polymers are sometimes used as defoamants although much higher concentrations are required.

Antiwear/extreme pressure additives include organic phosphorus compounds such as phosphines, phosphine oxides, phosphinites, phosphonites, phosphinates, phosphites, phosphonates, phosphates and phosphoroamidates. Polysulfides of thiophosphorous acids and thiophosphorous acid esters can also be used as antiwear additives.

Corrosion inhibitor additive components include thiadiazoles, such as 2,5-dimercapto-1,3,4-thiadiazoles and derivatives thereof; mercaptobenzothiazoles; alkyltriazoles; and benzotriazoles. Other common types include (short-chain) alkenyl succinic acids, partial esters thereof and nitrogen-containing derivatives thereof a. Oxidation Stability The blended lubricating composition has improved oxidation stability, improved antioxidation performance, and thus extended oil drain life, compared to other lubricating compositions. As stated above, the improved antioxidation performance is provided by the trithiophosphate-containing compound. Lower amounts of the trithiophosphate-containing compound are needed to provide equal to or better oxidation stability than other antioxidant additives. The lubricating composition also provides advantages relative to lubricating compositions including heavy metals, such as zinc. Thus, the lubricating composition provides high oxidation stability while creating less deposits on the machinery in which the lubricating composition is used, compared to lubricating compositions including heavy metals, and meets regulations and manufacturing standards on heavy metal content.

The antioxidation performance of each lubricating composition was determined by an oxidation stability test. The test included measuring the amount of time it took for the lubricating composition to obtain a 100 percent (%) increase in kinematic viscosity at 40° C., measured in hours. The test continued for 210 hours. First, the test included measuring the initial kinematic viscosity of the lubricating composition at 0 hours, such as by a viscometer. Next, the lubricating composition was placed in an oxidation test cell, together with copper naphthenate catalysts in the amount of 50 ppm dissolved in the lubricating composition. The test cell and its contents were placed in a heating block maintained at a specified temperature of 165° C. Dried air was then bubbled through the lubricating composition. The dried air was at 60° C. and flowed at a rate of 250 $cm^3$/min. The test cell was held at a pressure of 50 psig for the duration of the test. A constant temperature block, equipped with an electric heater and thermostatic control, was used to maintain the temperature of the lubricating composition within ±0.5° C. of the specified temperature of 165° C. Periodically, a sample of the lubricating composition was removed from the test cell, and the kinematic viscosity of the lubricating composition was measured at the same temperature as the 0 hr sample. The kinematic viscosity of the lubricating composition was measured at certain time intervals throughout the 210 hour test. The kinematic viscosity measured at the certain time intervals was compared to the initial kinematic viscosity of the lubricating composition. Oxidation of the lubricating composition would have been identified by a rapid increase in kinematic viscosity. Oxidation of the lubricating composition would have occurred at a kinematic viscosity of at least 100% greater than the initial kinematic viscosity. However, if at the end of the 210 hour test, the kinematic viscosity of the lubricating composition was less than 100% greater than the initial kinematic viscosity, then that indicated the lubricating composition did not oxidize and had good oxidation stability.

The antioxidation performance of each lubricating composition was also determined using the oxidation stability test described above, except for measuring the amount of time it took for the lubricating composition to obtain a 200% increase in kinematic viscosity at 40° C., measured in hours.

The test continued for 250 hours. If at the end of the 250 hour test the kinematic viscosity increase of the lubricating composition was less than 200% greater than the initial kinematic viscosity, then that indicated the lubricating composition did not oxidize and had good oxidation stability.

b. Kinematic Viscosity

The kinematic viscosity at 40° C. of the blended lubricating composition was measured according to the ASTM D445 standard. The blended lubricating composition of one embodiment had a kinematic viscosity of from 20 cSt to 1000 cSt at 40° C. and a corresponding ISO viscosity grade (VG) of 22 to 1000 and was suitable for use in industrial applications. The blended lubricating composition of another embodiment had an ISO viscosity grade of 150 to 1000 and was suitable for use in industrial gear applications.

The blended lubricating composition of one embodiment had a kinematic viscosity of from 28.8 cSt to 748 cSt at 40° C. and a thus a corresponding ISO VG of 32 to 680. The blended lubricating composition of another embodiment had a kinematic viscosity of from 41.4 cSt to 110 cSt at 40° C. and thus a corresponding ISO VG of 46 to 100. The blended lubricating composition of another embodiment had a kinematic viscosity of from 61.2 cSt to 74.8 cSt at 40° C. and a thus a corresponding ISO VG of 68.

The blended lubricating composition of one embodiment had a kinematic viscosity of not greater than 1000 cSt, or not greater than 900 cSt, or not greater than 350 cSt, or not greater than 120 cSt at 40° C.

The blended lubricating composition of one embodiment had a kinematic viscosity of at least 19 cSt, or at least 27 cSt, or at least 50 cSt, or at least 100 cSt at 40° C.

c. Viscosity Index

The viscosity index of the blended lubricating composition was measured according to the ASTM D2270 standard. In one embodiment, the blended lubricating composition had a viscosity index (VI) of from 130 to 200. In another embodiment, the blended lubricating composition had a viscosity index of from 135 to 190. In yet another embodiment, the blended lubricating composition had a viscosity index of from 140 to 176.

d. Specific Gravity

The specific gravity of the blended lubricating composition was measured according to the ASTM D4052 standard. In one embodiment, the blended lubricating composition had a specific gravity of from 0.7 g/cm$^3$ to 1 g/cm$^3$. In another embodiment, the blended lubricating composition had a specific gravity of from 0.8 g/cm$^3$ to 0.95 g/cm$^3$, or from 0.85 g/cm$^3$ to 0.9 g/cm$^3$.

IX. Examples a. Base Oil Blend

Table 1 includes a Group IV/Group V base oil blend, which was used to form the lubricating compositions of Inventive Examples 1 to 4 and Comparative Examples 5 to 18. The base oil blend had a kinematic viscosity of 70 cSt at 40° C. and an ISO VG grade of 68. The base oil blend included 19.9 wt. % of Group V base oil component, specifically alkylated naphthalene. The alkylated naphthalene had a kinematic viscosity of 5 cSt at 100° C.

The base oil blend also included 78.1 wt. % of a Group IV base oil component. The Group IV base oil component comprised a first polyalphaolefin base stock having a kinematic viscosity of 40 cSt at 100° C. and a second polyalphaolefin base stock having a kinematic viscosity of 4 cSt at 100° C. The base blend of Inventive Examples 1 to 4 and Comparative Examples 5 to 18 also included 2.0 wt. % performance additives, including 0.5 wt. % defoamant package, 1.0 wt. % cresyl diphenylphosphate (CDP), 0.25 wt. % amine phosphate, and 0.25 wt. % corrosion inhibitors.

TABLE 1

| Base Blend Composition (wt. %) | |
|---|---|
| Alkylated Naphthalene | 19.9 |
| PAO 40 | 40.82 |
| PAO 4 | 37.28 |
| Performance Additives | 2.0 |
| Total (wt. %) | 100 |

b. Compositions with the Trithiophosphate-Containing Compound

Table 2 lists Inventive Examples 1 to 4, which each included alkylated diphenyl amine and a trithiophosphate-containing compound, in addition to the base blend of Table 1. The trithiophosphate-containing compound had the following structure:

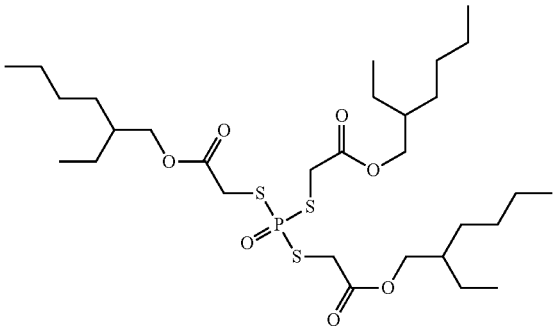

The trithiophosphate-containing compound and the alkylated diphenyl amine were provided in the form of a commercially available blend, including 50 wt. % S,S,S-Tris-carbo-2-isooctyloxy-methyl trithiophosphate and 50 wt. % alkylated diphenyl amine, based on the total weight of the commercially available blend. The lubricating compositions of the Inventive Examples each had a kinematic viscosity of about 70 cSt at 40° C., an ISO VG grade of 68, and were suitable for use as a circulating oil or in an industrial gear application.

Table 2 also lists Comparative Examples 4 to 8, which each included alkylated diphenyl amine and a trithiophosphate-containing compound in lower amounts than Inventive Examples 1-4, in addition to the base blend of Table 1.

TABLE 2

Inventive Examples 1-4 and Comparative Examples 5-8 Compositions (wt. %)

| | Base Blend | Alkylated Diphenyl Amine | Trithiophosphate-containing compound |
|---|---|---|---|
| Inventive Example 1 | 97.0 | 1.5 | 1.5 |
| Inventive Example 2 | 99.0 | 0.5 | 0.5 |
| Inventive Example 3 | 99.3 | 0.35 | 0.35 |
| Inventive Example 4 | 99.5 | 0.25 | 0.25 |
| Comparative Example 5 | 99.67 | 0.165 | 0.165 |

TABLE 2-continued

| Inventive Examples 1-4 and Comparative Examples 5-8 Compositions (wt. %) | | | |
|---|---|---|---|
| | Base Blend | Alkylated Diphenyl Amine | Trithiophosphate-containing compound |
| Comparative Example 6 | 99.7 | 0.15 | 0.15 |
| Comparative Example 7 | 99.83 | 0.085 | 0.085 |
| Comparative Example 8 | 99.9 | 0.05 | 0.05 |

c. Example Compositions without the Trithiophosphate-Containing Compound

Table 3 lists Comparative Examples 9A to 18C, which each included the base blend of Table 1, but did not include the trithiophosphate-containing compound. The lubricating compositions of Comparative Examples 9A to 18C each included at least one component that has been used to provide oxidation stability or improve antioxidation performance of Group IV/Group V lubricating compositions.

TABLE 3

Comparative Examples 9A-18C Compositions (wt. %)

| Comparative Examples | Base Blend | Alkylated Diphenyl Amine | Tri-thiophosphate ester | Alkylated phenyl alpha naphthyl amine | Dialkyl-bis-dithiocarbamate | Hindered phenol ester | Tetrakis-(methylene-(3,5-di-(tert)-butyl-4-hydro-cinnanate)methane |
|---|---|---|---|---|---|---|---|
| 9A | 97.0 | | | 3.0 | | | |
| 9B | 99.0 | | | 1.0 | | | |
| 9C | 99.5 | | | 0.5 | | | |
| 10A | 97.0 | 3.0 | | | | | |
| 10B | 99.0 | 1.0 | | | | | |
| 10C | 99.5 | 0.5 | | | | | |
| 11A | 97.0 | | | | 3.0 | | |
| 11B | 99.0 | | | | 1.0 | | |
| 11C | 99.5 | | | | 0.5 | | |
| 12A | 97.0 | | | | | 3.0 | |
| 12B | 99.0 | | | | | 1.0 | |
| 12C | 99.5 | | | | | 0.5 | |
| 13A | 97.0 | 2.1 | | | | | 0.45 |
| 13B | 99.0 | 0.7 | | | | | 0.15 |
| 13C | 99.5 | 0.35 | | | | | 0.075 |
| 14A | 97.0 | 2.4 | | | | | |
| 14B | 99.0 | 0.8 | | | | | |
| 14C | 99.5 | 0.4 | | | | | |
| 15A | 97.0 | 1.5 | | | | | |
| 15B | 99.0 | 0.5 | | | | | |
| 15C | 99.5 | 0.25 | | | | | |
| 16A | 97.0 | | | | | | |
| 16B | 99.0 | | | | | | |
| 16C | 99.5 | | | | | | |
| 17A | 97.0 | 2.58 | | | | | |
| 17B | 99.0 | 0.86 | | | | | |
| 17C | 99.5 | 0.43 | | | | | |
| 18A | 97.0 | 1.5 | | 1.5 | | | |
| 18B | 99.0 | 0.5 | | 0.5 | | | |
| 18C | 99.5 | 0.25 | | 0.25 | | | |

| Comparative Examples | Thiodiethylene bis[3-(3,5-di-tert-butyl-4-hydro-xyphenyl)propionate | Alkylated N-α-naphthyl-N-phenyl-amine | Hindered phenol sulfide | Alkylated phenothiazine |
|---|---|---|---|---|
| 9A | | | | |
| 9B | | | | |
| 9C | | | | |
| 10A | | | | |
| 10B | | | | |
| 10C | | | | |
| 11A | | | | |
| 11B | | | | |
| 11C | | | | |
| 12A | | | | |
| 12B | | | | |
| 12C | | | | |
| 13A | 0.45 | | | |
| 13B | 0.15 | | | |
| 13C | 0.075 | | | |
| 14A | 0.6 | | | |
| 14B | 0.2 | | | |

TABLE 3-continued

| Comparative Examples 9A-18C Compositions (wt. %) | | | | |
|---|---|---|---|---|
| 14C | 0.1 | | | |
| 15A | | 1.5 | | |
| 15B | | 0.5 | | |
| 15C | | 0.25 | | |
| 16A | | | 3.0 | |
| 16B | | | 1.0 | |
| 16C | | | 0.5 | |
| 17A | | | | 0.42 |
| 17B | | | | 0.14 |
| 17C | | | | 0.07 |
| 18A | | | | |
| 18B | | | | |
| 18C | | | | |

Table 4 lists the lubricating composition of Comparative Example 19, which included the trithiophosphate-containing compound, but included a Group III base oil, instead of the Group IV/Group V base oil blend. The API Group III base stock and had a kinematic viscosity of about 47 cSt 40° C., kinematic viscosity of about 7.6 cSt at 100° C., viscosity index of about 128; NOACK volatility of about 6 wt. %, pour point of about −12° C., and flash point of about 260° C. The lubricating composition also included 2.5 wt. % performance additives, including 1.0 wt. % defoamant package, 1.0 wt. % cresyl diphenylphosphate (CDP), 0.25 wt. % amine phosphate, and 0.25 wt. % corrosion inhibitors.

TABLE 4

| Comparative Example 19A-D Composition (wt. %) | | | | |
|---|---|---|---|---|
| | Group III Base Oil | Performance Additives | Alkylated Diphenyl Amine | Trithiophosphate-containing compound |
| Comparative Ex. 19A | 96.8 | 2.5 | 0.35 | 0.35 |
| Comparative Ex. 19B | 97.0 | 2.5 | 0.25 | 0.25 |
| Comparative Ex. 19C | 97.2 | 2.5 | 0.15 | 0.15 |
| Comparative Ex. 19D | 97.4 | 2.5 | 0.05 | 0.05 |

X. Experiments

A. Experiment 1—Antioxidation Performance

An experiment was conducted to compare the antioxidation performance of the lubricating compositions of Inventive Examples 2 and 4, and Comparative Examples 5 and 6, which included the trithiophosphate-containing compound, to the antioxidation performance of the base blend, which did not include the trithiophosphate-containing compound.

The antioxidation performance of each lubricating composition was determined using the 210 hour oxidation stability test described above. The test included measuring the amount of time it took for the lubricating composition to obtain a 100 percent (%) increase in kinematic viscosity at 40° C., measured in hours. First, the test included measuring the initial kinematic viscosity of the lubricating composition at 0 hours by a viscometer. Next, the lubricating composition was placed in an oxidation test cell, together with copper naphthenate catalysts in the amount of 50 ppm dissolved in the lubricating composition. The test cell and its contents were placed in a heating block maintained at a specified temperature of 165° C. Dried air was then bubbled through the lubricating composition. The dried air was at 60° C. and flowed at a rate of 250 $cm^3$/min. The test cell was held at a pressure of 50 psig for the duration of the test. A constant temperature block, equipped with an electric heater and thermostatic control, was used to maintain the temperature of the lubricating composition within ±0.5° C. of the specified temperature of 165° C. Periodically a sample of the lubricating composition was removed from the test cell, and the kinematic viscosity of the lubricating composition was measured at the same temperature as the 0 hr sample. The kinematic viscosity of the lubricating composition was measured at certain time intervals throughout the 210 hour test. The kinematic viscosity measured at the certain time intervals was compared to the initial kinematic viscosity of the lubricating composition. Oxidation of the lubricating compositions of the base blend and Comparative Examples 5 and 6 was identified by a rapid increase in kinematic viscosity. Oxidation of those lubricating compositions was determined by a kinematic viscosity of at least 100% greater than the initial kinematic viscosity. However, at the end of the 210 hour test, the kinematic viscosity of the lubricating compositions of Inventive Example 2 and 4 was less than 100% greater than the initial kinematic viscosity, which indicated those lubricating composition did not oxidize and had good oxidation stability. The antioxidation performance test results are shown in Table 5.

TABLE 5

| Antioxidation Performance (Hours to 100% Kinematic Viscosity Increase) | | | |
|---|---|---|---|
| | Trithiophosphate-containing compound (wt. %) | Alkylated diphenyl amine (wt. %) | Hours |
| Base Oil Blend | 0.0 | 0.0 | 23 |
| Inventive Ex. 2 | 0.5 | 0.5 | >210 |
| Inventive Ex. 4 | 0.25 | 0.25 | >210 |
| Comparative Ex. 5 | 0.165 | 0.165 | 145 |
| Comparative Ex. 6 | 0.085 | 0.085 | 112 |

The test results indicated that adding the trithiophosphate-containing compound and the alkylated diphenyl amine to the Group IV/Group V base oil blend significantly increased antioxidation performance and thus extended oil drain life. The lubricating compositions of Inventive Examples 2 and 4, and Comparative Examples 5 and 6 had significantly better oxidation stability than the base oil blend. The Inventive Examples did not oxidize until 210 hours or longer, which is significantly longer than time it took the base oil blend to oxidize, which was only 23 hours.

B. Experiment 2—Antioxidation Performance

An experiment was conducted to compare the antioxidation performance of Inventive Examples 1, 2, and 4 to the antioxidation performance of Comparative Examples 9 to 18. The trithiophosphate-containing compound and the alkylated diphenyl amine are referred to as an antioxidant component in Table 6. The experiment was also used to determine the effect of the trithiophosphate-containing compound on the antioxidation performance of the Group IV/Group V lubricating composition.

The antioxidation performance was measured using the oxidation stability test of Experiment 1, which included measuring the hours until at least 100% kinematic viscosity increase. Any result above 210 hours was extrapolated. The test results are shown in Table 6.

TABLE 6

Experiment 2, Antioxidation Performance (Hours to 100% Kinematic Viscosity Increase)

| | Antioxidant Component (wt. %) | Hours |
|---|---|---|
| Base Oil Blend | 0.0 | 23 |
| Inventive Example 1 | 3.0 | 279 |
| Comparative Example 9A | 3.0 | 258 |
| Comparative Example 10A | 3.0 | 288 |
| Comparative Example 11A | 3.0 | 185 |
| Comparative Example 12A | 3.0 | 71 |
| Comparative Example 13A | 3.0 | 192 |
| Comparative Example 14A | 3.0 | 309 |
| Comparative Example 15A | 3.0 | 100 |
| Comparative Example 16A | 3.0 | 182 |
| Comparative Example 17A | 3.0 | 309 |
| Comparative Example 18A | 3.0 | 170 |
| Inventive Example 2 | 1.0 | 275 |
| Comparative Example 9B | 1.0 | 118 |
| Comparative Example 10B | 1.0 | 184 |
| Comparative Example 11B | 1.0 | 115 |
| Comparative Example 12B | 1.0 | 49 |
| Comparative Example 13B | 1.0 | 108 |
| Comparative Example 14B | 1.0 | 107 |
| Comparative Example 15B | 1.0 | 48 |
| Comparative Example 16B | 1.0 | 125 |
| Comparative Example 17B | 1.0 | 140 |
| Comparative Example 18B | 1.0 | 88 |
| Inventive Example 4 | 0.5 | 272 |
| Comparative Example 9C | 0.5 | 82 |
| Comparative Example 10C | 0.5 | 118 |
| Comparative Example 11C | 0.5 | 125 |
| Comparative Example 12C | 0.5 | 46 |
| Comparative Example 13C | 0.5 | 53 |
| Comparative Example 14C | 0.5 | 63 |
| Comparative Example 15C | 0.5 | 44 |
| Comparative Example 16C | 0.5 | 81 |
| Comparative Example 17C | 0.5 | 97 |
| Comparative Example 18C | 0.5 | 68 |

The test results of Table 6 indicate that the trithiophosphate-containing compound and alkylated diphenyl amine provided high oxidation stability at a combined amount of 3.0 wt. %, and continued to provide high oxidation stability at combined amounts as low as 0.5 wt. %. This continued high oxidation stability was unexpected because each of the Comparative Examples experienced a significant reduction in oxidation stability when the amount of antioxidant component was reduced to less than 1.5 wt. %.

Inventive Example 4 did not oxidize until about 272 hours, which was significantly better than the Comparative Examples having the same amount of antioxidant component, significantly better than Comparative Examples 9B-18B having 0.5 wt. % more antioxidant component, and significantly better than Comparative Examples 12A, 13A, 15A, 16A, and 18A, which had 2.5 wt. % more antioxidant component. The oxidation stability of Inventive Example 4 was about equal to Inventive Example 1 and Comparative Examples 9A, 10A, 14A, and 17A, which also had 2.5 wt. % more antioxidant component. High oxidation stability with low amounts of additive component provided the advantage of reduced amount of deposits formed on machinery in which the lubricating composition was used and reduced likelihood of other problems associated with high levels of additives.

As stated above, the experiment was also used to determine the effect of the trithiophosphate-containing compound on the antioxidation performance of the Group IV/Group V lubricating composition. A comparison between Inventive Examples 1, 2, and 4 and Comparative Examples 10A-10C indicates the effect of the trithiophosphate-containing compound because the only difference between the Inventive Examples and Comparative Examples 10A-10C is the trithiophosphate-containing compound replacing half of the alkylated diphenyl amine. The comparison is shown in Table 7.

TABLE 7

| | Alkylated Diphenyl Amine | Trithiophosphate-containing compound | Hours |
|---|---|---|---|
| Inventive Example 1 | 1.5 | 1.5 | 279 |
| Comparative Ex. 10A | 3.0 | 0.0 | 288 |
| Inventive Example 2 | 0.5 | 0.5 | 275 |
| Comparative Ex. 10B | 1.0 | 0.0 | 184 |
| Inventive Example 4 | 0.25 | 0.25 | 272 |
| Comparative Ex. 10C | 0.5 | 0.0 | 118 |

Table 7 shows that in amounts less than 1.5 wt. %, the trithiophosphate-containing compound provided a significant improvement in oxidation stability.

A comparison between Inventive Example 4 and Comparative Example 10C illustrates that when 0.25 wt. % trithiophosphate-containing compound was added to the Group IV/Group V lubricating composition, the oxidation stability of the lubricating composition increased by 57%, from 118 hours to 272 hours.

However, a comparison between Comparative Example 10C and Comparative Example 10B illustrates that when the amount of alkylated diphenyl amine was increased by 0.5 wt. %, the oxidation stability of the Group IV/Group V lubricating composition increased by only 36%, from 118 to 184 hours. Thus, the improved oxidation stability provided by the trithiophosphate-containing compound in amounts less than 1.5 wt. % was unexpected.

D. Experiment 3—Group IV/Group V v. Group III base Oil Antioxidation Performance An experiment was conducted to compare the oxidation performance of the Group IV/Group V lubricating composition of Inventive Examples 3 and 4, and Comparative Examples 6 and 8 to the Group III base oil lubricating compositions of Comparative Examples 19A to 19D. The experiment also compared the effect of the trithiophosphate-containing compound and the alkylated diphenyl amine on the oxidation stability of the Group IV/Group V-based lubricant compared to a Group III-based lubricant.

The oxidation performance of each lubricating composition was measured by the hours to 200% kinematic viscosity increase according to the procedure described in Experiment 1, for up to 250 hours. The hours to 200% kinematic viscosity increase of the Group IV/Group V based lubricant and the Group III-based lubricant without the trithiophosphate-containing compound and the alkylated diphenyl amine was also measured as a reference. The results of Experiment 3 are shown in Table 8.

TABLE 8

Experiment 3, Antioxidation Performance (Hours to 200% Kinematic Viscosity Increase)

| | Antioxidant Additive Component (wt. %) | Hours |
|---|---|---|
| Group IV/Group V-based lubricant | 0.0 | 46 |
| Group III-based lubricant | 0.0 | 10 |
| Inventive Ex. 3 | 0.7 | >250 |
| Comparative Ex. 19A | 0.7 | 112 |
| Inventive Ex. 4 | 0.5 | >250 |
| Comparative Ex. 19B | 0.5 | 80 |
| Comparative Ex. 5 | 0.3 | 170 |
| Comparative Ex. 19C | 0.3 | 46 |
| Comparative Ex. 7 | 0.1 | 75 |
| Comparative Ex. 19D | 0.1 | 27 |

The test results indicate the Group IV/Group V-based lubricating compositions provided better antioxidation performance than the Group III-based lubricant compositions. The test results also indicate the trithiophosphate-containing compound and alkylated diphenyl amine were more effective in Group IV/Group V-based lubricating compositions, compared to Group III-based lubricant compositions.

The principles and modes of operation of this invention have been described above with reference to various exemplary and preferred embodiments. As understood by those of skill in the art, the overall invention, as defined by the claims, encompasses other preferred embodiments not specifically enumerated herein.

What is claimed is:

1. A lubricating composition comprising in admixture:

from 15 wt. % to 25 wt. % of a Group V base oil component, based on the total weight of the blend components that are used to produce the lubricating composition, wherein the Group V base oil component is alkylated naphthalene, from 65 wt. % to 85 wt. % of a Group IV base oil component, based on the total weight of the blend components that are used to produce the lubricating composition, wherein the Group IV base oil component is one or more polyalphaolefin base stocks, from 0.25 wt. % to 1.5 wt. % of a trithiophosphate-containing compound, based on the total weight of the blend components that are used to produce the lubricating composition, wherein the trithiophosphate-containing compound is S,S,S-Tris-carbo-2-isooctyloxy-methyl trithiophosphate, from 0.25 wt. % to 1.5 wt. % of alkylated diphenyl amine, based on the total weight of the blend components that are used to produce the lubricating composition, and not greater than 5 wt. % of a Group I, Group II, or Group III base oil component, based on the total weight of the blend components that are used to produce the lubricating composition, and wherein the 210 hour oxidation stability test of the lubricating composition yields a value greater than 210 hours.

2. The lubricating composition of claim 1, wherein the trithiophosphate-containing compound has a $M_w$ of 600 g/mol to 700 g/mol.

3. The lubricating composition of claim 1 including not greater than 1 wt. % of the trithiophosphate-containing compound, based on the total weight of the blend components that are used to produce the lubricating composition.

4. The lubricating composition of claim 1 including not greater than 1 wt. % of the trithiophosphate-containing compound and not greater than 1 wt. % of the alkylated diphenyl amine, based on the total weight of the blend components that are used to produce the lubricating composition.

5. The lubricating composition of claim 1, wherein the lubricating composition comprises not greater than 10 parts per million (ppm) of a heavy metal component, based on the total weight of the blend components that are used to produce the lubricating composition.

6. The lubricating composition of claim 1, wherein the lubricating composition comprises a total of at least 80 wt. % of the combined Group V base oil component and the Group IV base oil component, based on the total weight of the blend components that are used to produce the lubricating composition.

7. The lubricating composition of claim 1 wherein the Group IV base oil component has a kinematic viscosity of from 2 cSt to 2000 cSt at 40° C.

8. The lubricating composition of claim 1 wherein the blended lubricating composition has a kinematic viscosity of from 20 cSt to 1,000 cSt at 40° C.

9. The lubricating composition of claim 1 wherein the blended lubricating composition has a viscosity index (VI) of from 130 to 200.

10. The lubricating composition of claim 1 wherein the blended lubricating composition has an ISO VG grade of from 22 to 1000.

11. A method of producing a lubricating composition, comprising blending together at least the following components:

from 15 wt. % to 25 wt. % of a Group V base oil component, based on the total weight of the blend components that are used to produce the lubricating composition, wherein the Group V base oil component is alkylated naphthalene, from 65 wt. % to 85 wt. % of a Group IV base oil component, based on the total weight of the blend components that are used to produce the lubricating composition, wherein the Group IV base oil component is one or more polyalphaolefin base stocks, from 0.25 wt. % to 1.5 wt. % of a trithiophosphate-containing compound, based on the total weight of the blend components that are used to produce the lubricating composition, wherein the trithiophosphate-containing compound is S,S,S-Tris-carbo-2-isooctyloxy-methyl trithiophosphate, from 0.25 wt. % to 1.5 wt. % of alkylated diphenyl amine, based on the total weight of the blend components that are used to produce the lubricating composition, and not greater than 5 wt. % of a Group I, Group II, or Group III base oil component, based on the total weight of the blend components that are used to produce the lubricating composition, and wherein the 210 hour oxidation stability test of the lubricating composition yields a value greater than 210 hours.

12. A method of improving the antioxidation performance of a lubricating composition comprising in admixture from 15 wt. % to 25 wt. % of a Group V base oil component, based on the total weight of the blend components that are used to produce the lubricating composition, wherein the Group V base oil component is alkylated naphthalene, and from 65 wt.

% to 85 wt. % of a Group IV base oil component, based on the total weight of the blend components that are used to produce the lubricating composition, wherein the Group IV base oil component is one or more polyalphaolefin base stocks, the method comprising the step of:

adding to the lubricating composition from 0.25 wt. % to 1.5 wt. % of a trithiophosphate-containing compound, based on the total weight of the blend components that are used to produce the lubricating composition, wherein the trithiophosphate-containing compound is S,S,S-Tris-carbo-2-isooctyloxy-methyl trithiophosphate, adding to the lubricating composition from 0.25 wt. % to 1.5 wt. % of a alkylated diphenyl amine, based on the total weight of the blend components that are used to produce the lubricating composition, wherein the lubricating composition contains not greater than 5 wt. % of a Group I, Group II, or Group III base oil component, based on the total weight of the blend components that are used to produce the lubricating composition, and wherein the 210 hour oxidation stability test of the lubricating composition yields a value greater than 210 hours.

* * * * *